US011512455B2

(12) United States Patent
Prather, Jr.

(10) Patent No.: US 11,512,455 B2
(45) Date of Patent: Nov. 29, 2022

(54) BUCKET CLAW SYSTEM

(71) Applicant: Walter Prather, Jr., Baldwyn, MS (US)

(72) Inventor: Walter Prather, Jr., Baldwyn, MS (US)

( * ) Notice: Subject to any disclaimer, the term of this patent is extended or adjusted under 35 U.S.C. 154(b) by 239 days.

(21) Appl. No.: 16/813,784

(22) Filed: Mar. 10, 2020

(65) Prior Publication Data

US 2021/0285188 A1 Sep. 16, 2021

(51) Int. Cl.
*E02F 3/40* (2006.01)
*E02F 9/28* (2006.01)
*E02F 3/76* (2006.01)

(52) U.S. Cl.
CPC ..... *E02F 9/2808* (2013.01); *E02F 3/40* (2013.01); *E02F 3/7604* (2013.01)

(58) Field of Classification Search
CPC ..... E02F 3/40; E02F 3/7604; E02F 3/8152; E02F 9/2808
See application file for complete search history.

(56) References Cited

U.S. PATENT DOCUMENTS 2,346,567 A * 4/1944 Forte ..... E02F 3/8152 172/778
2,354,560 A * 7/1944 Troup ..... E02F 3/7604 172/695
2,396,739 A * 3/1946 McCauley ..... E02F 3/8152 172/777
2,468,380 A * 4/1949 Smith ..... E02F 3/8155 172/664
2,566,547 A * 9/1951 Bartlett ..... E02F 3/8152 172/445.2
2,700,833 A * 2/1955 Small ..... E02F 3/8152 172/710
2,774,155 A * 12/1956 Hipp ..... E02F 3/8152 172/197
2,840,931 A * 7/1958 Appel ..... E02F 3/3408 172/136
2,899,760 A * 8/1959 Armington et al. .. E02F 3/8155 172/476
2,996,818 A * 8/1961 Buuck ..... E02F 3/8155 172/777
3,034,238 A * 5/1962 McGee ..... E02F 3/8152 172/197
3,596,996 A * 8/1971 Carter ..... E02F 3/962 299/24
3,834,567 A * 9/1974 Miller ..... A01D 87/0053 37/405

(Continued)

*Primary Examiner* — Jamie L Mcgowan
(74) *Attorney, Agent, or Firm* — David J. Kreher

(57) ABSTRACT

A bucket claw system and method of use wherein the bucket claw system comprises a bucket, either wedge shaped or flat bottomed, that is attached to a piece of heavy equipment such as a loader or skid-steer, wherein the bucket further comprises a plurality of teeth on the outside of the bucket, on the back portion of the bucket, in the area of the transition from the bottom portion of the bucket and the back portion. The bucket claw system can be used by rotating the front edge of the bucket up, exposing the plurality of teeth to the ground, and then moving the plurality of teeth along the ground in order to clear an area of scrap limbs, brush, vines, grass, roots, and undergrowth.

1 Claim, 7 Drawing Sheets

(56) References Cited

U.S. PATENT DOCUMENTS 4,041,624 A * 8/1977 Fryrear ..... E02F 3/40 414/722
4,056,205 A * 11/1977 Etzler, IV ..... B66F 9/12 414/722
4,303,507 A * 12/1981 Smith ..... E02F 3/401 37/405
4,327,509 A * 5/1982 Bean ..... E02F 3/425 37/404
4,407,080 A * 10/1983 Mann ..... E02F 3/7609 37/405
4,448,260 A * 5/1984 Harmsen ..... E02F 3/8155 172/136
4,512,090 A * 4/1985 Billings ..... E02F 3/815 37/405
4,709,492 A * 12/1987 Watson ..... E01H 5/066 37/270
4,854,811 A * 8/1989 Veys ..... E02F 3/345 414/718
4,967,850 A * 11/1990 Bargfrede ..... F41H 11/24 172/197
5,413,181 A * 5/1995 Keigley ..... E02F 3/815 37/302
5,425,189 A * 6/1995 Anderson ..... E02F 9/2816 37/405
5,515,625 A * 5/1996 Keigley ..... E02F 3/815 37/405
6,257,342 B1 * 7/2001 Szatko ..... A01B 31/00 172/540
6,434,863 B1 * 8/2002 Meurer ..... E02F 3/962 414/722
6,490,815 B1 * 12/2002 Pratt ..... E02F 3/962 37/444
6,546,650 B1 * 4/2003 Meurer ..... E02F 3/401 37/405
6,662,478 B1 * 12/2003 Virnig ..... E02F 3/962 37/444
6,910,290 B1 * 6/2005 Meurer ..... E02F 3/404 37/405
7,562,473 B2 * 7/2009 Westendorf ..... E02F 3/40 37/268
10,597,848 B1 * 3/2020 Finch ..... E02F 3/8152
10,704,224 B1 * 7/2020 Hauer ..... E02F 9/2271
2004/0187365 A1 * 9/2004 Archuleta, Jr. ..... E02F 3/962 37/406
2008/0053674 A1 * 3/2008 Frederick ..... E02F 3/8152 172/684.5
2012/0186112 A1 * 7/2012 Tulibaski ..... E02F 3/404 37/195
2013/0101341 A1 * 4/2013 McDonald ..... F16H 1/28 403/62
2015/0259876 A1 * 9/2015 Zimmerman ..... E02F 3/407 239/214
2016/0002891 A1 * 1/2016 Myers ..... E02F 3/96 172/430
2020/0291601 A1 * 9/2020 Stocks ..... E02F 9/2858
2021/0062462 A1 * 3/2021 Killniak ..... E02F 3/8152

* cited by examiner

BUCKET CLAW SYSTEM

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC

Not Applicable

DESCRIPTION

Field of the Invention

A bucket is attached is a device attached to a piece of construction equipment such as a loader or skid-steer. The bucket is used to move aside or load and transport material. The bucket claw system comprises a plurality of teeth attached to the outside back portion of the bucket in the area of the transition from the bottom portion of the bucket to the back portion of the bucket and the bucket teeth are used to move and scrap limbs, brush, vines, grass, roots, and undergrowth without inhibiting the usual functions of the bucket. Further, bucket teeth can be either retrofitted onto an existing bucket to create the bucket claw system or be included in the design of a new wedge-bottom or flat bottom bucket.

Background of the Invention

Buckets attached to a piece of construction equipment are used to move aside or load and transport material. These buckets can be either permanently attached to a piece of heavy equipment or be detachable so that another type of attachment that serves a different function can be attached to the piece of construction equipment. In order to clear an area of scrap limbs, brush, vines, grass, roots, and undergrowth, the operator of the piece of heavy equipment must then either change pieces of heavy equipment, attached an additional apparatus to the bucket, or disconnect the bucket and connect another attachment to the heavy equipment. Having additional pieces of heavy equipment or multiple attachments is expensive. Being required to swap out one attachment for another, or attaching something onto a bucket in order to be able to clear an area of scrap limbs, brush, vines, grass, roots, and undergrowth is time consuming. The present disclosure reveals a bucket that also has a plurality of teeth attached to the outside of the bucket in the area of the transition from the bottom portion of the bucket to the back portion of the bucket so that, when the front of the bucket is rotated up, the teeth can engage the ground and be moved along to clear scrap limbs, brush, vines, grass, roots, and undergrowth. Having a bucket that can be used to move aside or load and transport material and clear an area of scrap limbs, brush, vines, grass, roots, and undergrowth, saves money and time.

SUMMARY OF THE INVENTION

The present disclosure reveals a bucket claw system comprising a plurality of teeth attached to the outside of a bucket of a piece of construction equipment in the area of the transition from the bottom portion of the bucket to the back portion of the bucket, so that bucket can be used to move aside or load and transport material and the teeth of the bucket claw system can be used to clear an area of scrap limbs, brush, vines, grass, roots, and undergrowth, as well as a method of use.

The bucket claw system comprises a plurality of teeth attached along the outside of the bucket in the area of the transition from the bottom portion of the bucket to the back portion of the bucket, along the length of the bucket that extends from the left side of the bucket to the right side of the bucket. Each tooth of the plurality of teeth are attached to the bucket along an attachment edge and each tooth extends out from the bucket along the tooth length to the front edge of the tooth.

Each individual bucket tooth can be tapered along either the width and/or height of the tooth from the point of attachment at the bucket to the front edge of the tooth.

The method of use in association with bucket teeth involves rotating the front of the bucket up to expose the plurality of teeth to the ground, and then moving the bucket forward, allowing the plurality of teeth to move along the ground and thus clear an area of scrap limbs, brush, vines, grass, roots, and undergrowth.

AMENDED DETAILED DESCRIPTION OF THE INVENTION

Figure 1:
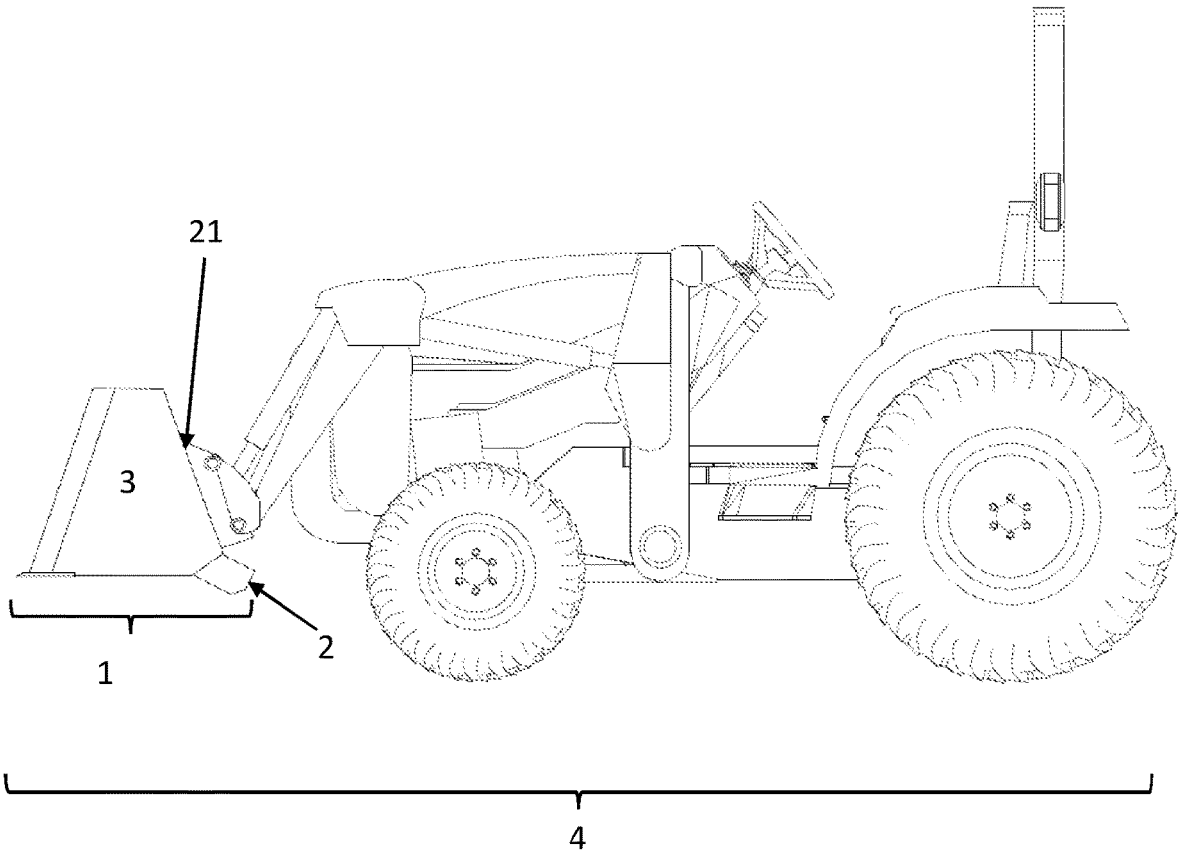
FIG. 1 is an image of a bucket claw system with a plurality of teeth on a loader.
Figure 2:
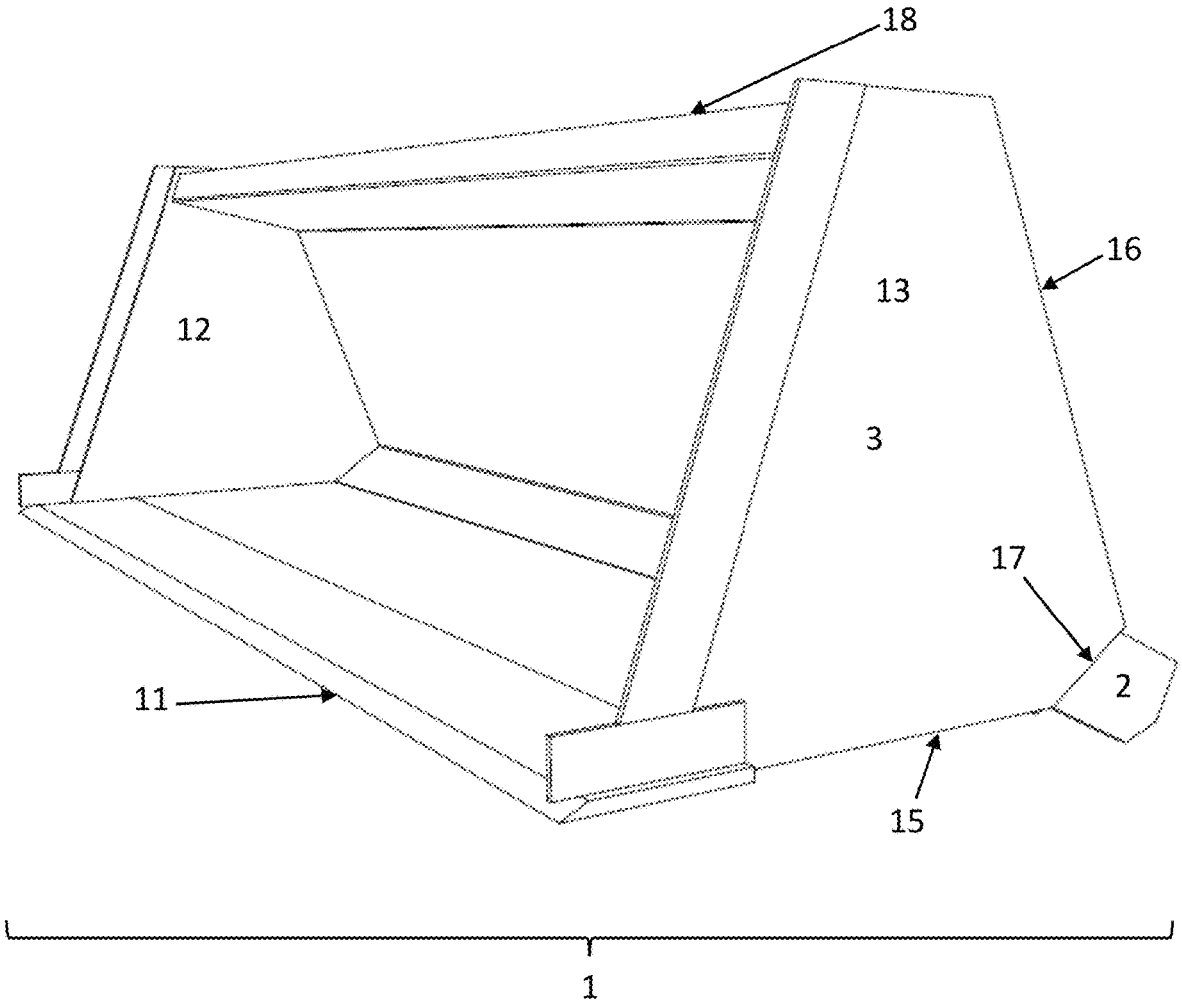
FIG. 2 is an image of a side view of a wedge-bottom bucket and plurality of teeth.
Figure 3:
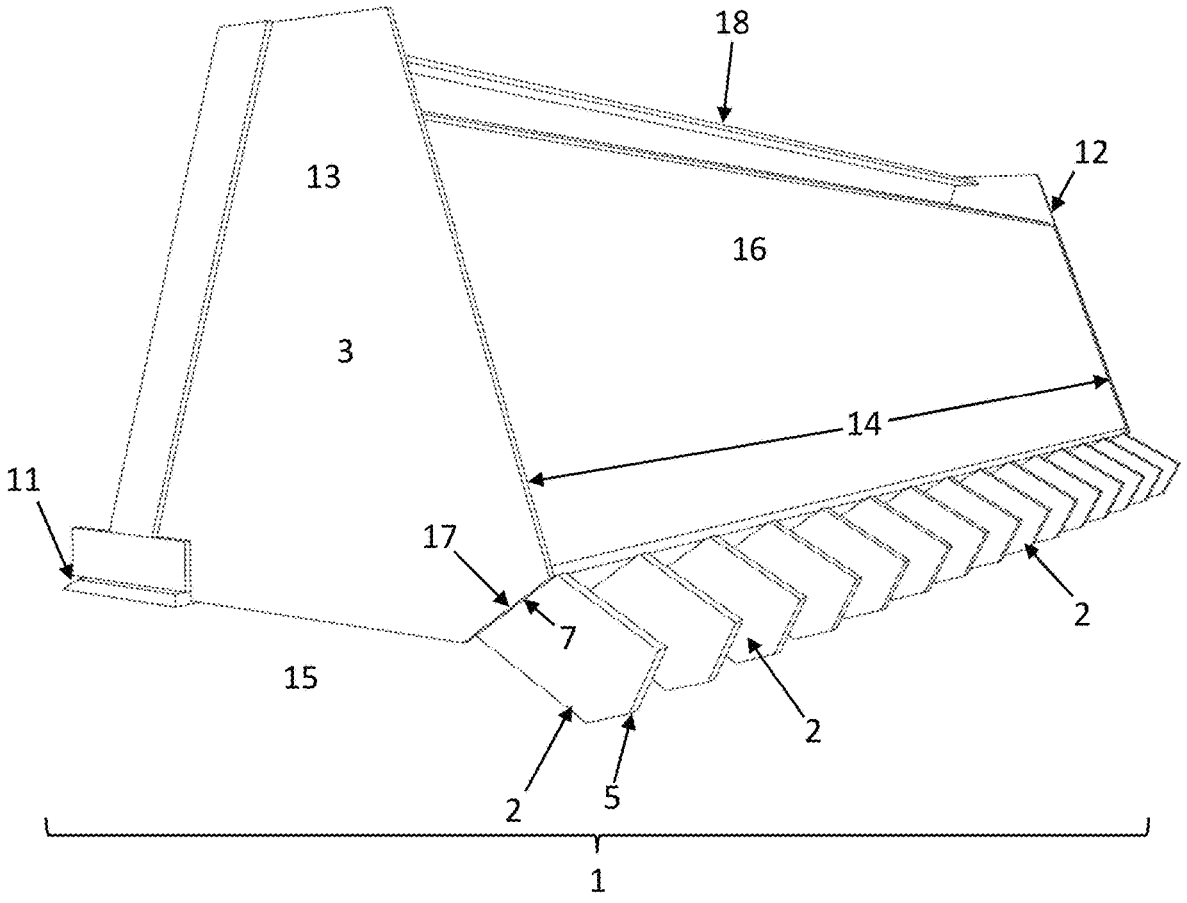
FIG. 3 is an image of the back portion of a bucket indicating the location of the plurality of teeth along the length between the left side and the right side of the bucket.
Figure 4A:
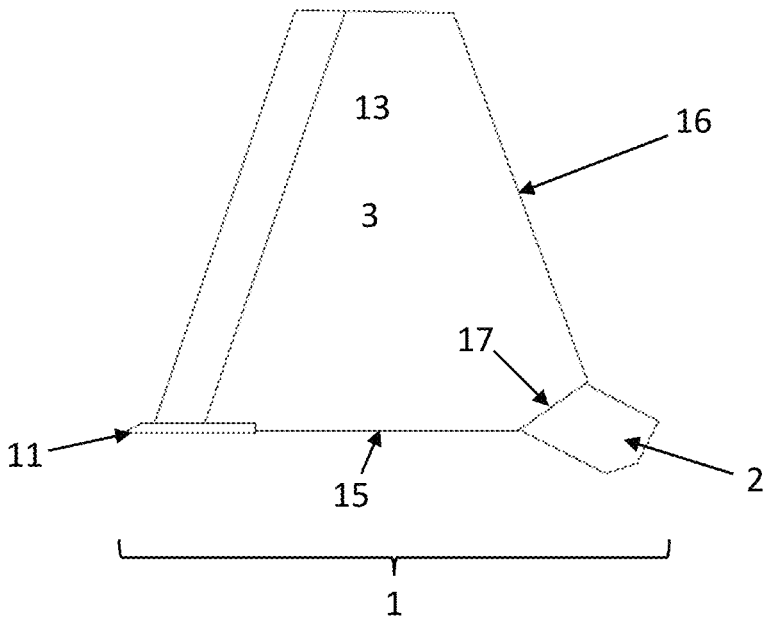
FIG. 4A is an image an example of a bucket wherein the image is of a side view of a bucket wherein the transition is an angle and the teeth are attached within the transition.
Figure 4B:
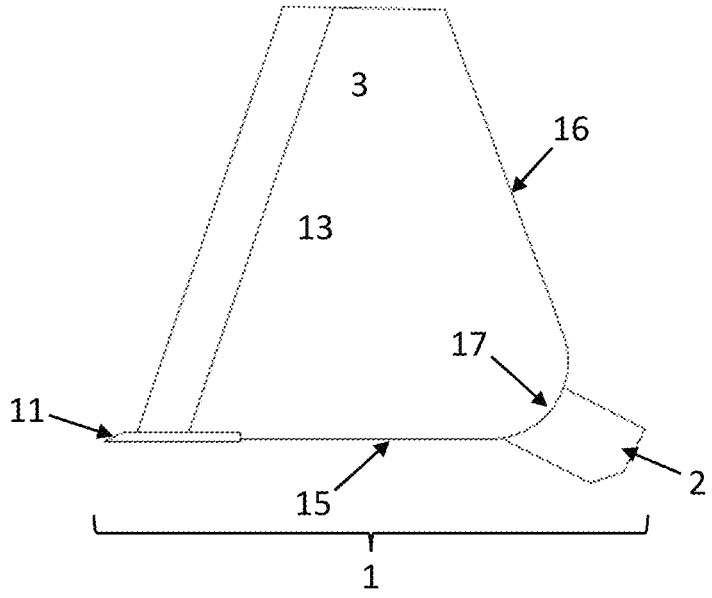
FIG. 4B is an image an example of a bucket wherein the image is a side view of a bucket wherein the transition is a curve and the teeth are attached within the transition.
Figure 4C:
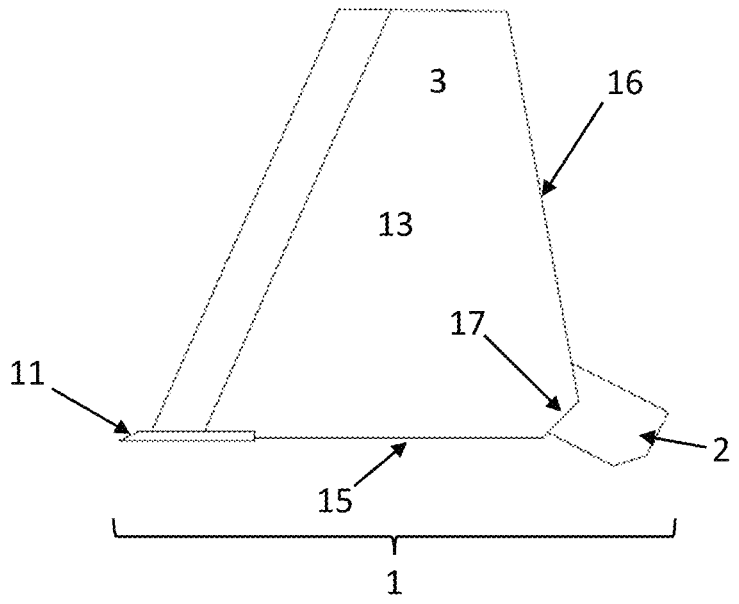
FIG. 4C is an image an example of a bucket wherein the image is of a side view of a bucket wherein the transition zone is an angle and the teeth are attached at the back portion and the transition.
Figure 4D:
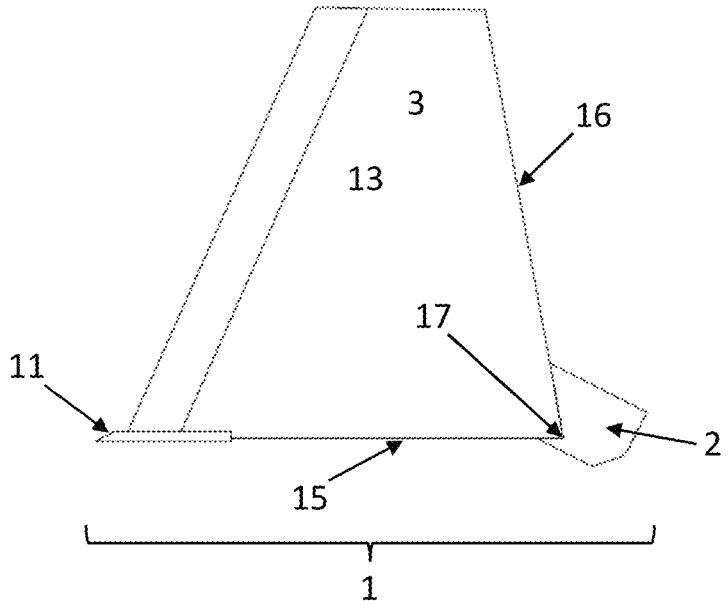
FIG. 4D is an image an example of a bucket wherein the image is of a side view of a bucket wherein the transition is where the bottom portion and the back portion meet and the teeth are attached to the bottom portion and back portion
Figure 5A:
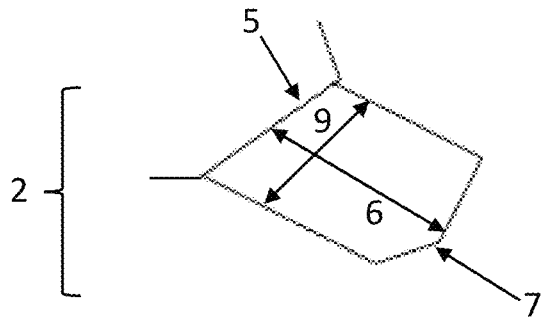
FIG. 5A is an image of a tooth with a constant thickness.
Figure 5B:
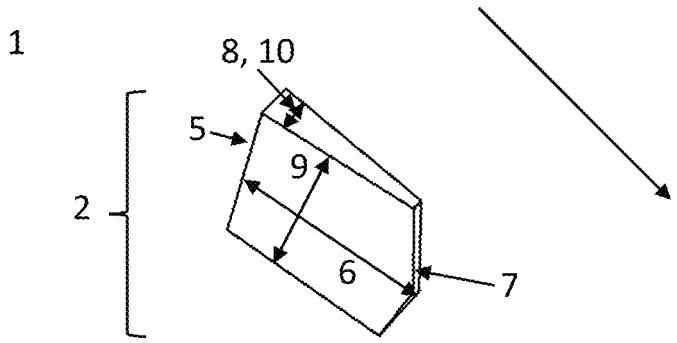
FIG. 5B is an image of a tooth that tapers along the width of the tooth.
Figure 5C:
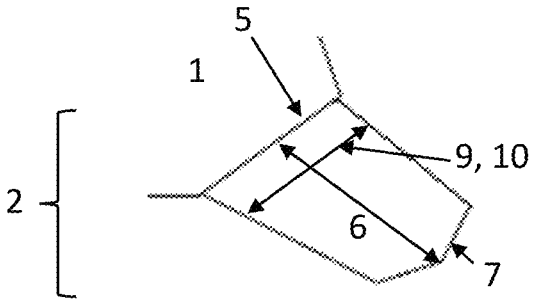
FIG. 5C is an image of a tooth wherein the height of the tooth tapers along the length of the tooth.
Figure 6:
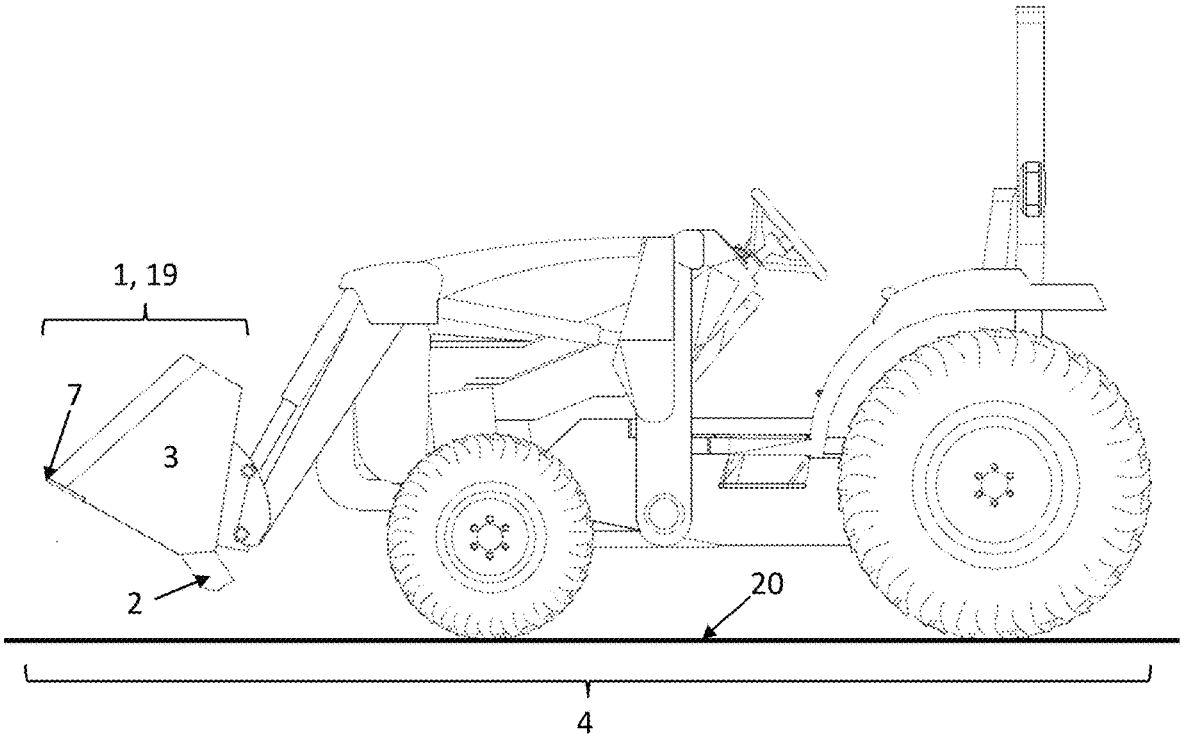
FIG. 6 is an image of the bucket rotated up to expose the plurality of teeth so that the bucket can then be lowered and thus clear an area of scrap limbs, brush, vines, grass, roots, and undergrowth.

The present disclosure reveals a bucket claw system 1 comprising a plurality of teeth 2 attached to a bucket 3 of a piece of heavy equipment 4 such as a loader or skid-steer so that the plurality of teeth 2 can be used to clear an area of scrap limbs, brush, vines, grass, roots, and undergrowth.

Each tooth 2 of a plurality of teeth 2 that is attached to a bucket 3 comprises an attachment edge 5, a tooth length 6, a leading edge 7, a width 8, and a height 9. Each tooth 2 may have a continuous thickness from the attachment edge 5 to the leading edge 7 or may be tapered 10 along the width 8 and/or the height 9. When the width 8 of the tooth 2 is tapered 10, the tooth 2 is thicker at the attachment edge 5, thinner at the leading edge 7, and the width 8 tapers 10 from the attachment edge 5 to the leading edge 8. When the height 9 of the tooth 2 is tapered 10, the height 9 of the tooth 2 is greater at the attachment edge 5, and less at the leading edge 7, and tapers 10 from the attachment edge 5 to the leading edge 7.

A bucket 3 comprises a front edge 11, a left side 12, a right side 13, a length 14 between the left side 12 and the right side 13, a bottom portion 15, a back portion 16, a transition 17, an outside 18 and a connection area 21.

Each tooth 2 of the plurality of teeth 2 is attached to the bucket 3 on the outside 18 of the bucket 3 in the area of the transition 17 where the bottom portion 15 of the bucket 3 joins to the back portion 16, wherein said tooth 2 attached to the bucket at the attachment edge 5, and each tooth 2 is attached to the bucket 3 along the length 14 that extends from the left side 12 to the right side 13, and each tooth 2 of the plurality of teeth 2 extends out from the bucket 3 along the tooth length 6, to the leading edge 7. The connection area 21 is the area on the bucket where the bucket attaches to the piece of heavy equipment by either traditional welding or bolting or by a quick connect/disconnect.

The method 14 of use of a bucket claw system 1 wherein the bucket claw system 1 comprises a bucket 3 and a plurality of teeth 2 wherein the method 14 comprises rotating the front edge 11 of the bucket 3 up to expose the plurality of teeth 2 located in the area of the transition 17 of the bucket 3 so that the plurality of teeth 2 are oriented toward the ground 20 and then moving the bucket 3 forward, allowing the plurality of teeth 2 to move along the ground 20 and thus clear an area of scrap limbs, brush, vines, grass, roots, and undergrowth.

What is claimed:

1. A bucket claw system for use with heavy equipment plurality of teeth attached to a bucket of a piece of heavy equipment to clear an area of scrap limbs, brush, vines, grass, roots, and undergrowth, the bucket claw system consisting of:

a bucket and a plurality of teeth;

the bucket consists of a front edge, a left side, a right side, a length between the left side and the right side, a bottom portion, a back portion, a transition, an outside, and a connection area;

each tooth of the plurality of teeth that are attached to a bucket consists of an attachment edge, a tooth length, a leading edge, a width, and a height;

each tooth of the plurality of teeth are attached to the outside of the bucket in the area of the transition where the bottom portion of the bucket joins to the back portion, along the length that extends from the left side to the right side, and each tooth of the plurality of teeth extends out from the bucket along the tooth length, to the leading edge; and wherein each tooth of the plurality of teeth has at least one of a continuous thickness from the attachment edge to the leading edge, each tooth of the plurality of teeth is tapered, wherein the tooth is thicker at the attachment edge, thinner at the leading edge, and the width of the tooth tapers from the attachment edge to the leading edge, each tooth of the plurality of teeth is tapered, wherein the tooth is thicker at the attachment edge, thinner at the leading edge, and the height of each tooth tapers from the attachment edge to the leading edge, or wherein each tooth of the plurality of teeth is tapered, wherein the tooth is thicker at the attachment edge, thinner at the leading edge, and the width and height of each tooth tapers from the attachment edge to the leading edge.

* * * * *